United States Patent [19]

Saito et al.

[11] 4,334,761

[45] Jun. 15, 1982

[54] ELECTROPHOTOGRAPHIC COPYING MACHINE

[75] Inventors: Masao Saito, Kamakurashi; Hiroshi Aoya, Ayaseshi; Naruhito Yoshida, Fujisawashi, all of Japan

[73] Assignee: Tokyo Shibaura Denki Kabushiki Kaisha, Kanagawa, Japan

[21] Appl. No.: 188,100

[22] Filed: Sep. 17, 1980

[30] Foreign Application Priority Data

Nov. 16, 1979 [JP] Japan ..... 54-158869[U]

[51] Int. Cl.[3] ..... G03G 15/00

[52] U.S. Cl. ..... 355/3 R

[58] Field of Search ..... 355/3 R, 18, 72

[56] References Cited

U.S. PATENT DOCUMENTS 3,966,316 6/1976 Pfeifer et al. ..... 355/15 X 4,045,135 8/1977 Doi et al. ..... 355/3 R

*Primary Examiner*—Michael L. Gellner

*Attorney, Agent, or Firm*—Schuyler, Banner, Birch, McKie & Beckett

[57] ABSTRACT

An electrophotographic copying machine is disclosed which comprises a machine body, an upper unit having a holder for holding an original placed thereon, the upper unit being pivotally mounted to a first side of the machine body so that the other side of the upper unit can be opened. The machine also comprises a copy paper supply device for holding copy paper and a receptacle for receiving the developed copy paper. The copy paper supply device and the receptacle are both provided on the other or second side of the machine body.

4 Claims, 3 Drawing Figures

ELECTROPHOTOGRAPHIC COPYING MACHINE

BACKGROUND OF THE INVENTION

The present invention relates to improvements in an electrophotographic copying machine.

Electrophotographic copying machines, particularly desk type copying machines, are extensively used in general offices because they can be easily operated and require little space for installation. In such electrophotographic copying machines, copying is accomplished by depressing a print button after placing an original on a holder on top of the machine. Copy paper is supplied from a cassette, which is mounted on one end of the machine. The developed copy paper is discharged onto a receptacle provided on the other end of the body. Since the cassette and the receptacle are on opposite ends of the machine, the size of the machine as a whole is larger than necessary and certain restrictions are placed on the installation location. Furthermore, when all the copy paper in the cassette is used up, it is necessary to remove the cassette from the machine before inserting additional copy paper. And, when the copying process is completed, the developed copy paper must be removed from the receptacle which is on the other end of the machine. Thus in order to operate the machine, the user of the electrophotographic copying machine must go back and forth along the machine which is an undesirable aspect from the standpoint of convenience.

Jamming of copy paper in the machine happens from time to time for one reason or another. In such a case, the jammed copy paper must be removed. To remove the jammed copy paper, it is necessary to open at least a portion of the machine where the jamming occurs. Quite frequently, the jamming occurs in a portion of the machine below the holder, where the fixing device fixes a visible image on the copy paper. Thus, an inner mechanism below the holder is desirable for readily opening the machine.

SUMMARY OF THE INVENTION

It is an object of the present invention to provide an electrophotographic copying machine with greater flexibility by overcoming the above disadvantages of the prior art.

It is a further object of the present invention to provide an electrophotographic copying machine which has an inner mechanism which can be readily inspected.

Finally, it is an object of the present invention to provide an electrophotographic copying machine which is easily operated.

The present invention is directed to an electrophotographic copying machine comprising a machine body, an upper unit having a holder for holding an original placed thereon, the upper unit being pivotally mounted to a first side of the machine body so that a second side of the machine can be opened. Further, a copy paper supply device and a receptacle for receiving the developed copy paper are both provided on the second side of the machine body.

DETAILED DESCRIPTION OF THE PREFERRED EMBODIMENT

Figure 1:
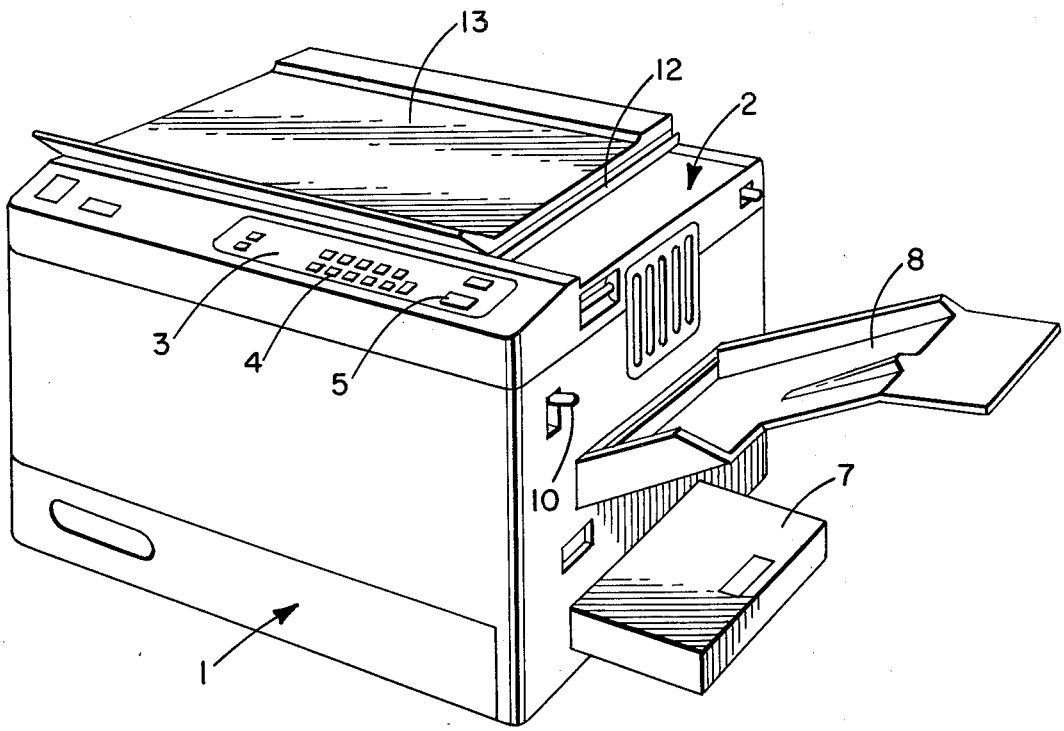
FIG. 1 is a perspective view showing an embodiment of the present invention.
Figure 3:
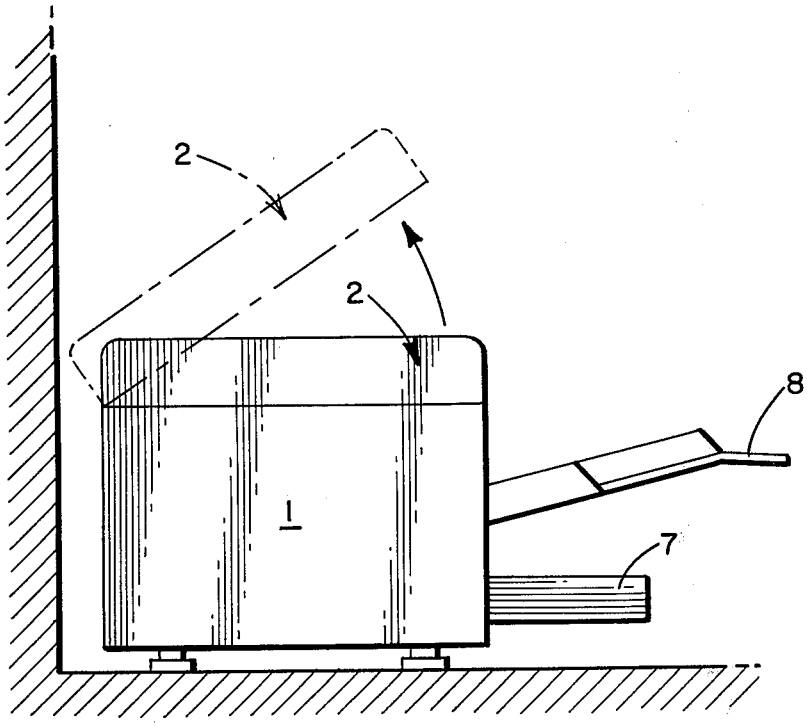
FIG. 3 is a view showing the installation of the electrophotographic copying machine of the present invention.
Figure 2:
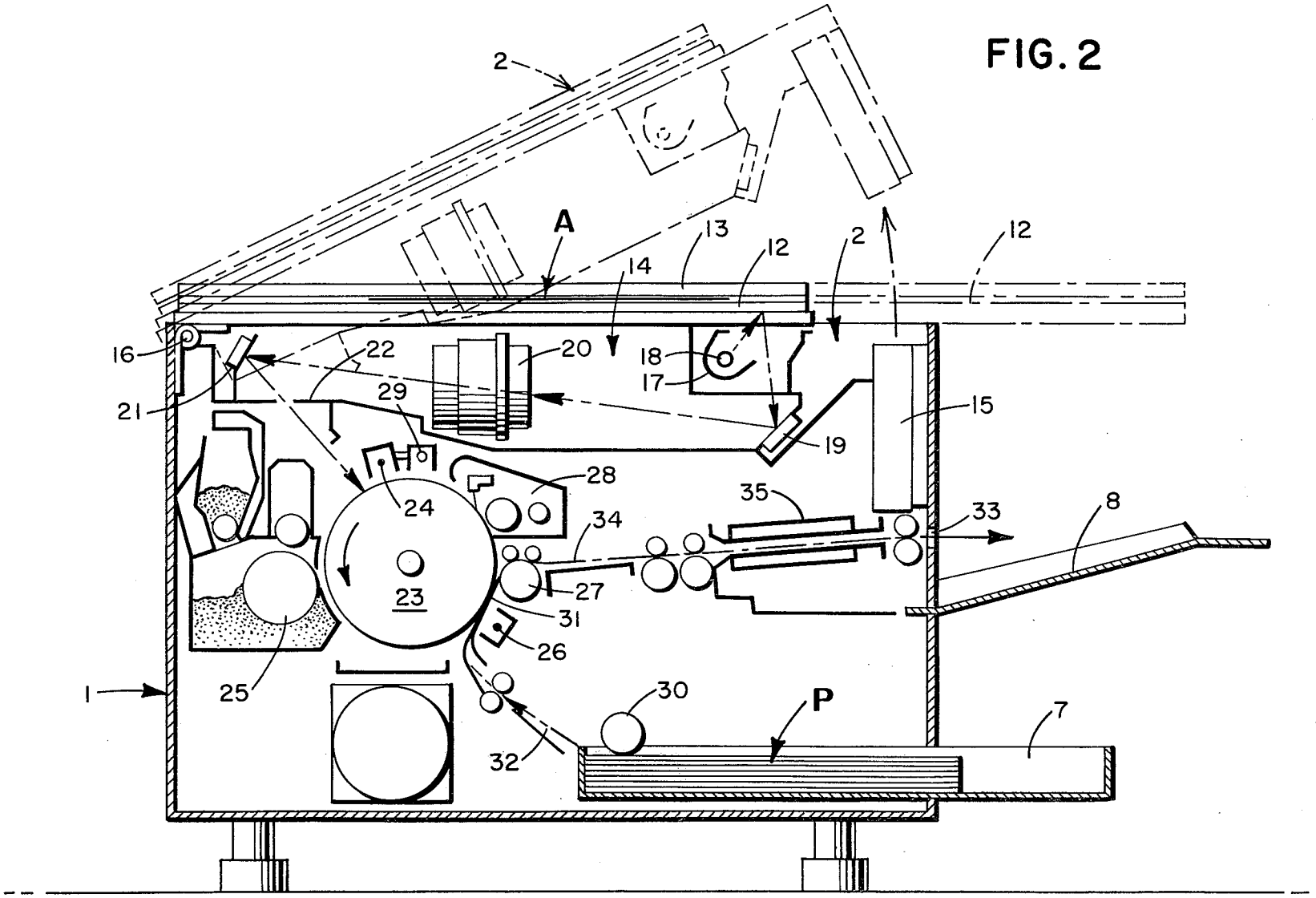
FIG. 2 is a sectional schematic view of FIG. 1.

Referring now to FIGS. 1–3, an explanation will be given regarding a preferred embodiment of the invention. As shown in FIG. 1, the electrophotographic copying machine of the present invention comprises a machine body 1, an upper unit 2, a copy paper supply device or a cassette 7 and a receptacle 8. The upper unit 2 is upwardly rotatable about a support point at the left side of the top of the machine body 1. Also, an operating panel 3 is provided at the front side of the top of the machine body 1. The operating panel 3 includes a ten-key pad 4 for inputing the desired number of copies and a print button 5. The cassette 7 which is inserted on the right side of the machine, extends or projects from this end of the machine. The receptacle 8 is also provided on the right side of the machine body 1 above the cassette 7 for receiving developed copy paper. A lock release lever 10 is provided at the right side of the machine body 1 for releasing the inside lock (not shown) by pushing down the lever 10. Holder 12 is reciprocatively provided on the upper unit 2 and a cover 13 covers the holder 12 for holding the original.

As shown in FIG. 2, the upper unit 2 includes the holder 12, optical exposure unit 14 and exhaust fan 15. The exhaust fan 15 is provided for exhausting air from inside the machine body 1 to prevent the temperature from increasing inside the machine body 1. The upper unit 2 is pivoted on the left side of the machine body 1 via hinge 16. The optical exposure unit 14 comprises a lamp 18 with the back side thereof surrounded by a reflector 17, a first mirror 19, a lens unit 20, a second mirror 21 and a slit member 22. The image of the original A set on the holder 12 is focused on a photosensitive drum 23 to form a latent image thereon.

The photosensitive drum 23 is located inside the machine body 1 and it is linked to an appropriate drive means (not shown) to rotate in the direction indicated by the arrow. A corona charger 24 is provided adjacent the drum 23 for applying a uniform electrostatic charge to the photosensitive drum 23. A developing device 25 is provided adjacent the drum 23 for developing the electrostatic latent image formed by the optical exposure unit 14. A corona charger 26 is located right below the drum 23 for transferring the developed image to a sheet of copy paper P. A turn roller 27 is located adjacent the corona charger 26 for guiding the sheet of copy paper P which contains the transferred image. A cleaner 28 contacts the drum 23 for removing the residual developer from the drum 23. A lamp 29 is located adjacent the drum 23 for discharging the residual electrostatic charge.

A sheet feed roll 30 removes copy paper P one-by-one from the cassette 7. The copy paper P is transported along a sheet feed path 32, a transfer section 31 and sheet feed path 34. A fixing device 35 is provided along the sheet feed path 34 for fixing the transferred image onto the sheet of copy paper P. A sheet outlet 33 is located on the right side of the machine body 1 for discharging the sheet of copy paper P in the receptacle 8.

When the print button 5 is depressed after setting the original A on the holder 12 and setting the number of desired copies, the photosensitive drum 23 starts to rotate. The surface of the photosensitive drum 23 passes by the lamp 29 which eliminates the residual charge of the drum 23. The surface of the drum 23 then is uniformly precharged by the corona charger 24. Next, the holder 12 moves over the right side of the machine body 1 with the lamp 18 in the "on" state. As a result, a slight exposure of the surface of the drum 23 to the optical image of the original A occurs through the exposure unit 14 to form an electrostatic image on the surface of the drum 23. Subsequently, the electrostatic latent image is developed to a visible image as the drum 23 passes by the developing device 25.

Meanwhile, in synchronism with the formation of an image on the surface of the drum 23, the sheet of copy paper P is taken from the cassette 7 and fed into the transfer section 31 along the sheet feed path 32. The visible image formed on the drum 23 is transferred onto the sheet of copy paper P by the action of the corona charger 26. The sheet of copy paper P is then guided by the turn roller 27 and fed along the sheet feed path 34 to the fixing device 35 where the transferred image on the sheet of copy paper P is fixed. Finally, the sheet of copy paper P is discharged through the outlet 33 to the receptacle 8.

As the surface of the drum 23 passes by the cleaner 28, the residual toner on the drum 23 is removed by the cleaner 28. The drum 23 then again faces the lamp 29 and the process is repeated.

When jamming of the copy paper P in the sheet feed path 34 or in the fixing device 35 occurs, or when inspecting the inside of the machine body 1, the upper unit 2 is rotated about the hinge 16. The user first pushes down the lock release lever 10 and raises its right end so that it is supported in an open inclined position as shown by broken lines in FIGS. 2–3 by a support mechanism (not shown). When closing the upper unit 2 the right end of the unit 2 is lowered and the unit 2 is automatically locked with the machine body 1.

As shown in FIG. 3, since the cassette 7 and receptacle 8 are provided on the right side of the machine body 1 and the upper unit 2 is operable from the right side for opening and closing, the copying machine can be used in a location in which its left side is in close proximity to a wall or structure. Also, when the sheet copy paper P in the cassette 7 is used up, the cassette 7 can be taken out from the right side of the machine body 1 for adding more copy paper P. After the copying process is completed, the developed copy paper P discharged onto the receptacle 8 can be simply taken out from the right side of the machine. Thus, all the operations required at the time of copying, such as opening and closing the upper unit 2, loading and unloading the cassette 7 and removing developed copy paper P from the receptacle 8 can be simply made only on the right side of the machine body 1.

Although a preferred embodiment of the present invention has been described with reference to the drawings, it is apparent that various modifications may be made in the electrophotographic copying machine by one skilled in the art without departing from the scope and spirit of the present invention.

We claim:

1. In an electrophotographic copying machine having a machine body including first and second sides opposite each other, an upper unit having a reciprocating original holder for holding an original placed thereon, said upper unit being pivotally mounted on said machine body and movable between a closed position during normal operation and an open inclined position when the machine is not operating, a copy paper supply device on said machine body for supplying copy paper to the machine and a receptacle on said machine body for receiving the developed copy paper, the improvement comprising said upper unit being pivotally mounted to said first side of said machine body, said reciprocating original holder of said upper unit extending over only said second side of said machine body and not said first side during reciprocation of said reciprocating holder on said machine body and said copy paper supply device and said receptacle both being located on said second side of said machine body.

2. The electrophotographic copying machine of claim 1 wherein said upper unit includes an exposure means for transmitting an optical image of the original to a photosensitive member located in said machine body and an exhaust fan for exhausting air from within said machine body to prevent the temperature from rising inside said machine body.

3. The electrophotographic copying machine of claim 1 wherein said receptacle is located directly above said copy paper supply device.

4. The electrophotographic copying machine of claim 1 wherein said copy paper supply device includes a cassette containing copy paper, said cassette being loaded and unloaded from said second side of said machine body.

* * * * *